US005615721A

United States Patent [19]

Winter

[11] Patent Number: 5,615,721

[45] Date of Patent: Apr. 1, 1997

[54] SHOWER ROD ATTACHMENTS

[75] Inventor: Paul H. Winter, Wilmington, Del.

[73] Assignee: Zenith Products Corp., Aston, Pa.

[21] Appl. No.: 517,934

[22] Filed: Aug. 22, 1995

[51] Int. Cl.[6] ..... E04F 10/00

[52] U.S. Cl. ..... 160/38; 160/384; 160/DIG. 6; 248/200.1; 248/264

[58] Field of Search ..... 160/38, 330, 384, 160/DIG. 6; 248/200.1, 264, 262, 268; 4/558, 608

[56] References Cited

U.S. PATENT DOCUMENTS

| | | | |
|---|---|---|---|
| 905,142 | 12/1908 | Bond | 248/264 |
| 1,057,043 | 3/1913 | Dohm | 248/262 |
| 1,711,463 | 4/1929 | Paul | 160/349.1 X |
| 4,700,918 | 10/1987 | Andrasko, Jr. | 248/264 X |
| 4,782,882 | 11/1988 | Amedeo et al. | 248/200.1 X |
| 5,031,257 | 7/1991 | Jeffery | 4/608 X |

*Primary Examiner*—Blair Johnson
*Assistant Examiner*—Bruce A. Lev
*Attorney, Agent, or Firm*—Edgar A. Zarins; Malcolm L. Sutherland

[57] ABSTRACT

An attachment for tension mounted shower rods to provide decorative accents to the shower rod. The attachment includes an L-shaped bracket extending from a circular member adapted to be positioned between the end of the shower rod and the wall. The L-shaped bracket is designed to extend out in front of the shower rod and accepts a decorative accent. The accent piece frictionally engages the bracket allowing exchange of accents for a variety of ornamental appearances.

5 Claims, 2 Drawing Sheets

SHOWER ROD ATTACHMENTS

BACKGROUND OF THE INVENTION

I. Field of the Invention

This invention relates to decorative accents for a shower rod and, in particular, to a bracket selectively mountable to a tension mounted shower rod and adapted to receive a decorative accent piece.

II. Description of the Prior Art

Home interior decorating has extended to every room of the home including the bathroom. Shower curtains that match window treatments and decorative accents on countertops and wallpaper are conventional means of adding decorative touches to the bath. The shower rod provides a means for adding decorative hardware to the bath.

In the prior known shower rods, decorative designs may be formed directly in the body of the shower rod. However, such fixed designs provide no flexibility to the user and require substantial inventory to offer a complete line of designs. The designs may be formed along the length of the rod or as emblems molded or fixed to the rods.

SUMMARY OF THE PRESENT INVENTION

The present invention overcomes the disadvantages of the prior known decorative accents for shower rods by providing a bracket removably mountable to the ends of the shower rod for securing decorative accents.

The shower rod attachment of the present invention is selectively mountable to the end of a tension mounted shower rod to be positioned between the end of the rod and a wall of the bath. Although secured to the end of the shower rod to simplify installation of the rod, the attachment is held in place by the tension applied by the shower rod against the well. The attachment includes a circular member which is sandwiched by the tension fitting of the shower rod against the wall of the bath. In a preferred embodiment, the circular member is cup-shaped to matingly receive the end of the shower rod.

Extending from the circular mounting member is an L-shaped bracket. The bracket includes a first arm connected to the circular member and a second arm integrally formed with the first arm disposed so as to extend parallel to the shower rod. The second arm includes means for mounting a decorative accent piece such that the accent is positioned out in front of the shower rod. The attachment of the present invention therefor facilitates ornamentation of a shower rod upon installation of the rod and allows choosing or interchanging of the decorative accent to suit the tastes of the consumer.

Other objects, features and advantages of the invention will be apparent from the following detailed description taken in connection with the accompanying drawings.

BRIEF DESCRIPTION OF THE DRAWING

The present invention will be more fully understood by reference to the following detailed description of a preferred embodiment of the present invention when read in conjunction with the accompanying drawing, in which like reference characters refer to like parts throughout the views and in which.

DETAILED DESCRIPTION OF A PREFERRED EMBODIMENT OF THE PRESENT INVENTION

Figure 1:
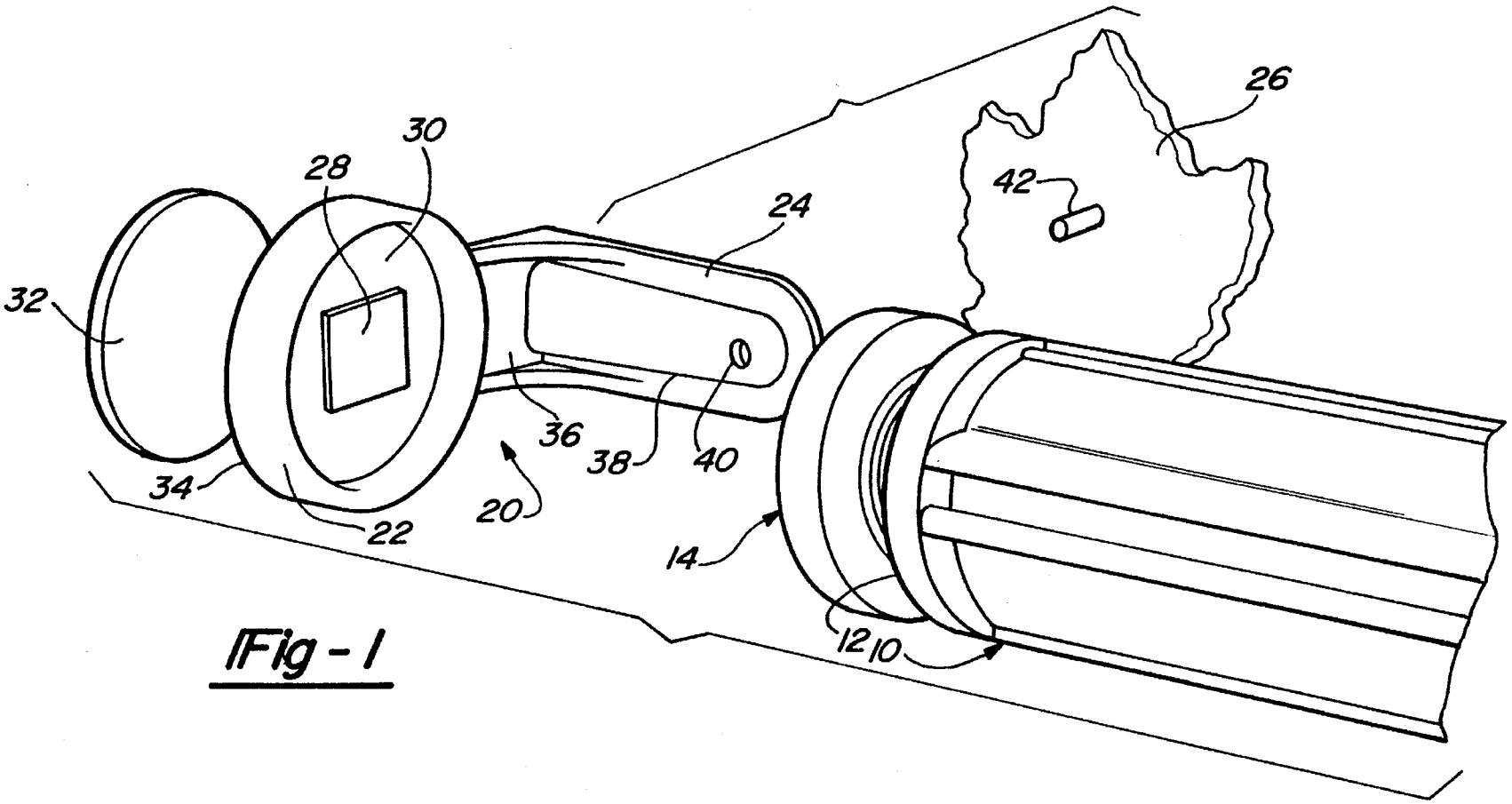
FIG. 1 is a rear exploded view of the attachment and shower rod.
Figure 2:
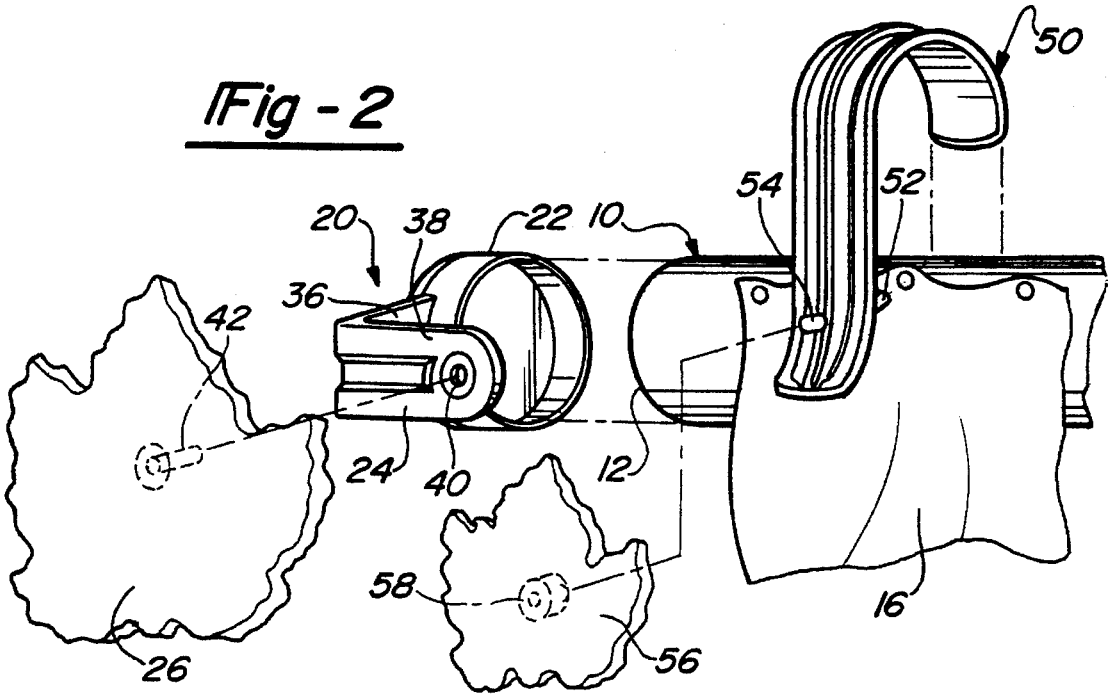
FIG. 2 is a front exploded view of the attachment and shower rod.
Figure 3:
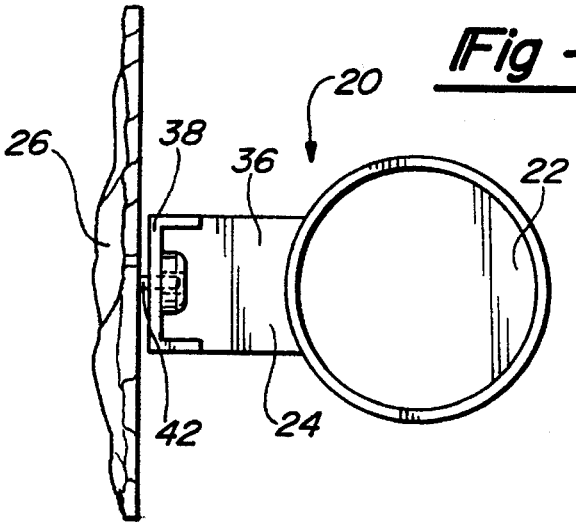
FIG. 3 is an end view of the attachment for the shower rod.
Figure 4:
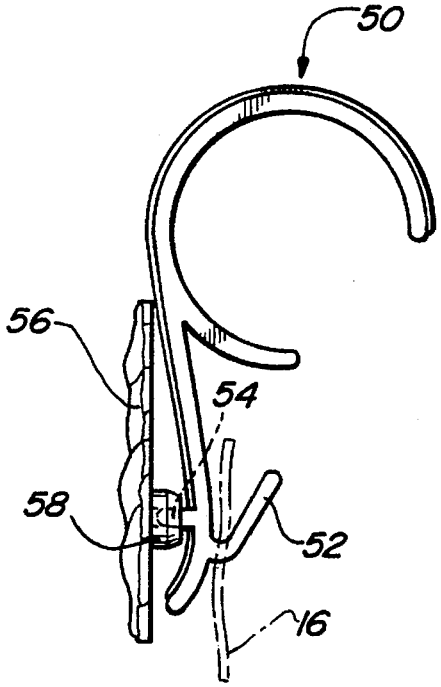
FIG. 4 is a side view of a decorative clip slidably mountable to the shower rod.

Referring to FIGS. 1 and 3, there is shown a shower rod 10 adapted to be mounted between two opposing walls (not shown) of a bath/shower stall. The shower rod 10 includes ends 12 preferably having an adjustable tension mechanism 14 for securing the shower rod 10 between the walls. As is well known, the tension mechanism 14 may be adjusted according to the distance between the walls and applies an outwardly directed force against the walls to hold the shower rod 10 in position. Once positioned, a shower curtain 16 may be slidably mounted to the shower rod 10.

In order to provide decorative ornamentation to the shower rod 10, an attachment 20 is provided in accordance with the present invention. The attachment 20 is designed to be disposed between the ends 12 of the shower rod 10 and the corresponding wall in order to accessorize the ends of the shower rod 10. The attachment 20 includes a mounting member 22 positionally captured between the end 12 of the shower rod 10 and the wall and a bracket arm 24 extending forwardly of the mounting member 22 in order to position a decorative accent piece 26 out in front of the shower rod 10.

In a preferred embodiment of the attachment 20, the mounting member 22 has a cylindrical cup-shaped configuration adapted to matingly receive the end 12 of the shower rod 10. To improve the gripping action of the shower rod 10, an inner friction pad 28 may be mounted to an inner surface 30 of the mounting member 22 and an outer friction pad 32 may be mounted to an outer surface 34 of the mounting member 22. The inner pad 28 improves contact with the end 12 of the shower rod 10 while facilitating mounting of the attachment 20 to the shower rod 10 during installation. Similarly, the outer pad 32 improves engagement of the assembly to the shower wall.

The bracket arm 24 integrally formed with and extending from the mounting member 22 includes means for removably receiving the accent piece 26. The arm 24 includes a first segment 36 extending substantially perpendicular to the axis of the mounting member 20 and shower rod 10. A second segment 38 extends perpendicular to the first segment 36 to be disposed substantially parallel to the axis of the shower rod 10. As a result, the second segment 38 is positioned out in front of the shower rod 10. The second segment 38 includes an aperture 40 for receiving the accent piece 26 such that the accent 26 is in front of the shower rod 10. The accent piece 26 preferably includes a stud 42 which is received in the aperture 40 to removably mount the accent 26 to the attachment 20. Thus, the attachment 20 of the present invention provides a simple and convenient assembly for adding decorative accents to a shower rod 10.

Additional decorative accents can be added to the hooks 50 used to hang the shower curtain 16. In addition to the inner stud 52 used to attach the curtain 16, outer stud 54 may be utilized to mount a decorative accent 56. The accent 56 is provided with a boss 58 which receives the outer stud 54. Accordingly, decorative accents 56 may be added to the curtain hooks 50 which match the accents 26 secured at the ends 12 of the shower rod 10.

The foregoing detailed description has been given for clearness of understanding only and no unnecessary limitations should be understood therefrom as some modifications will be obvious to those skilled in the art without departing from the scope and spirit of the appended claims.

What is claimed is:

1. An attachment for a bathroom shower rod for securing a decorative accent to the shower rod, the shower rod having an end adapted to engage a wall for positioning of the shower rod, said attachment comprising:

a decorative accent piece having a mounting stud;

a circular mounting member having a circular end wall and a tubular side wall, said mounting member adapted to receive the end of the shower rod such that the circular end wall of said mounting member is positionally captured between the end of the shower rod and the wall; and an L-shaped bracket arm extending from said mounting member and including means for receiving a decorative accent piece, said bracket arm having a first segment extending forwardly from said mounting member and a second segment disposed perpendicular to said first segment to position said accent piece in front of said attachment when said mounting member is attached to said wall, and said means for receiving comprising an aperture in said second segment.

2. The attachment as defined in claim 1 wherein said means for receiving said accent piece comprises an aperture formed in said second segment of said bracket arm, said aperture matingly receiving a stud formed on said accent piece to display said accent piece forwardly of said mounting member.

3. An attachment for a bathroom shower rod securing a decorative accent to the shower rod, the shower rod having an end adapted to engage a wall for positioning of the shower rod, said attachment comprising:

a decorative accent piece having a mounting stud;

a cup-shaped mounting member having a circular end wall and a tubular side wall, said mounting member adapted to matingly receive the end of the shower rod such that the circular end wall of said mounting member is positionally captured between the end of the shower rod and the wall; and an L-shaped bracket arm integrally formed with said mounting member, said bracket arm including means for receiving said decorative accent piece, a first segment extending forwardly from said mounting member substantially perpendicular to said tubular side wall and a second segment extending from said first segment and disposed substantially parallel to an axis of said tubular side wall, said second segment having a means for receiving a decorative accent piece to position said accent piece in front of said mounting member when said mounting member is attached to said wall, and said means for receiving comprising an aperture in said second segment.

4. An improved shower rod assembly including a shower rod having an end adapted to engage a wall for positioning of the shower rod, the improvement comprising:

a decorative accent piece having a mounting stud;

a cup-shaped mounting member having a circular end wall and a tubular side wall, said mounting member adapted to matingly receive the end of the shower rod such that said end wall is positionally captured between the end of the shower rod and the wall;

an L-shaped bracket arm integrally formed with said cup-shaped mounting member, said bracket arm having a first segment extending from perpendicular to said tubular side all of said mounting member and a second segment extending from said first segment substantially parallel to an axis to said tubular side wall;

means for receiving a decorative accent piece comprising an aperture formed on said second segment of said bracket arm wherein said bracket arm extends forwardly of the shower rod to position said accent piece in front of the shower rod when said mounting member is attached to said wall.

5. The improvement as defined in claim 4 and further comprising a friction pad attached to an outer surface and an inner surface of said circular end wall of said mounting member.

* * * * *